US010918230B1

(12) United States Patent
Dompierre

(10) Patent No.: US 10,918,230 B1
(45) Date of Patent: Feb. 16, 2021

(54) CONSTRUCTION FOR PILLOW COVER

(71) Applicant: Finaryrre LLC, Marmora, NJ (US)

(72) Inventor: Victor J Dompierre, Marmora, NJ (US)

(73) Assignee: Finaryrre LLC, Marmora, NJ (US)

( * ) Notice: Subject to any disclaimer, the term of this patent is extended or adjusted under 35 U.S.C. 154(b) by 77 days.

(21) Appl. No.: 16/535,198

(22) Filed: Aug. 8, 2019

(51) Int. Cl.
*A47G 9/02* (2006.01)
*A47C 31/10* (2006.01)
*A47G 9/10* (2006.01)

(52) U.S. Cl.
CPC ..... *A47G 9/0253* (2013.01); *A47C 31/10* (2013.01); *A47G 9/10* (2013.01); *A47G 9/1054* (2013.01)

(58) Field of Classification Search
CPC ..... A47G 9/10; A47G 9/1054; A47G 9/1072; A47G 9/109; A47G 2009/1018; A47C 31/10; A47C 27/001; A47C 27/002
See application file for complete search history.

(56) References Cited

U.S. PATENT DOCUMENTS 2,183,418 A * 12/1939 Williams ..... A47G 9/1045 5/485
5,157,799 A * 10/1992 Aird ..... A47G 9/0253 5/490
5,628,093 A 5/1997 Goodale
6,367,083 B1 * 4/2002 November ..... A47G 9/064 2/69.5
6,928,675 B2 * 8/2005 Hamilton ..... A47G 9/0253 5/490
6,954,957 B2 10/2005 Metzger et al.
7,013,509 B2 3/2006 Hickman
D840,723 S 2/2019 Dompierre
2004/0019972 A1 * 2/2004 Schecter ..... A47G 9/10 5/645
2004/0128764 A1 7/2004 McGranth et al.
2005/0097673 A1 5/2005 Matthews Brown et al.
2007/0256241 A1 * 11/2007 Harmon ..... A47G 9/0253 5/489
2009/0293198 A1 * 12/2009 Fodge ..... A47C 31/10 5/653
2018/0325291 A1 * 11/2018 Holbrook ..... A47G 9/0253

* cited by examiner

*Primary Examiner* — Robert G Santos
*Assistant Examiner* — Rahib T Zaman
(74) *Attorney, Agent, or Firm* — Flaster/Greenberg PC

(57) ABSTRACT

A cover for a shaped article, such as a pillow, is constructed by attaching first and second cover portions, each defined by a cover body having a peripheral edge. A first zipper portion is attached to the first cover portion and a second zipper portion is attached to second cover portion. The zipper fastener secure cover portions together, forming an interior storage pocket. One or more gussets are located along the peripheral edge of the corners of the cover portions. The gussets are formed by a first fold transverse to the peripheral edge and a second fold positioned perpendicular to the peripheral edge. The second fold creates an overlapping portion along the edge of the cover portion, which is secured to the peripheral edge.

14 Claims, 9 Drawing Sheets

CONSTRUCTION FOR PILLOW COVER

FIELD OF THE INVENTION

The present disclosure relates to the construction of a cover for a shaped article, with the cover having first and second portions that are releasably fastened together.

BACKGROUND

It is known to construct covers for pillows, mattresses and other shaped articles using two or more portions that are attached by a zipper or a similar fastener. Examples of such cover constructions are shown in US 2009/0293198 to Fodge et al. and U.S. Pat. No. 6,954,957 to Metzger et al.

There remains a need for a simple construction, with the assembled cover having a pleasing appearance.

SUMMARY

A construction for a cover for a shaped article, such as a pillow, cushion or other article, is defined by first and second cover portions, each having a cover body and a peripheral edge. A first releasable fastener portion, such as one half of a zipper, is attached to the peripheral edge of the first cover portion and a second fastener or zipper portion is attached to the peripheral edge of the second cover portion. The fastener portions are adapted to releasably join to one another. When joined, the fastener portions secure the peripheral edges of the first and second cover portions, forming an interior pocket for storage of the shaped article. A gusset is located along the peripheral edge of at least one of the cover portions. Preferably, multiple gussets are provided at the corners of the cover portions. Each gusset is contemplated to be formed by a transverse first fold, with the fold forming a pointed edge. A second fold is positioned perpendicular to the peripheral edge. The second fold creates an overlap of the pointed edge along the periphery of the cover portion. The pointed edge and adjacent overlapping portion of the cover periphery are secured to one another. Preferably the overlapped is created on an outside surface of the cover portion and the gusset is positioned relatively inwardly from the peripheral edge.

The cover construction may further be defined by the body of one or both of the first and second cover portions having a rectangular shape. The rectangle may in one embodiment have equal length side edges and may form a square shape. Further, the gusset is preferably formed at each corner of the rectangle. Still further, the first fold may be formed substantially transverse to the corner of the rectangular shape of the cover body, with the line of the fold at an angle of substantially forth-five degrees from the peripheral side edges of the cover body.

A cover for a shaped article is further contemplated to include top and bottom cover portions, with the cover portions each having a similarly formed cover body and defined periphery. A first fastener portion, preferably a zipper half, is attached to the periphery of the top cover portion and a second portion is attached to the periphery of the bottom cover portion. At least one of the top and bottom cover portions having a gusset located along the periphery of the respective cover portion. The gusset is preferably created by a first fold extending inwardly from the periphery of the respective cover portion to form a pointed edge. A second fold is spaced from the pointed edge and positioned transverse to the periphery of the respective cover portion. The pointed edge is positioned along the periphery and adjacent to the second fold, with the pointed edge and an overlapping portion being secured to the cover periphery. The gusset is formed relatively inward of the overlap formed by the second fold. The first and second fastener portions are adapted to removably join to attach the cover portions, thus forming an interior pocket for storage of the shaped article.

The cover construction may be further defined by cover bodies having a rectangular shape, with a gusset preferably formed at each corner of the rectangle. The first fold for each gusset is preferably formed along a line extending inwardly from the corner and is preferably at an angle of substantially forty-five degrees from the adjacent peripheral edges of the cover body. The second fold for each gusset is preferably formed perpendicular to the adjacent peripheral edge. The second fold for each gusset has a height, which for each gusset is preferably equal. Two adjacent gussets on each cover portion may further be directed inwardly towards one another.

Other features of the present invention will become apparent from the detailed description to follow, taken in conjunction with the accompanying drawings.

BRIEF DESCRIPTION OF THE DRAWINGS

FIG. 1 shows an exploded view of an embodiment of a cover construction as contemplated by the present invention, along with a pillow shaped article in between.

DETAILED DESCRIPTION

Figure 1:
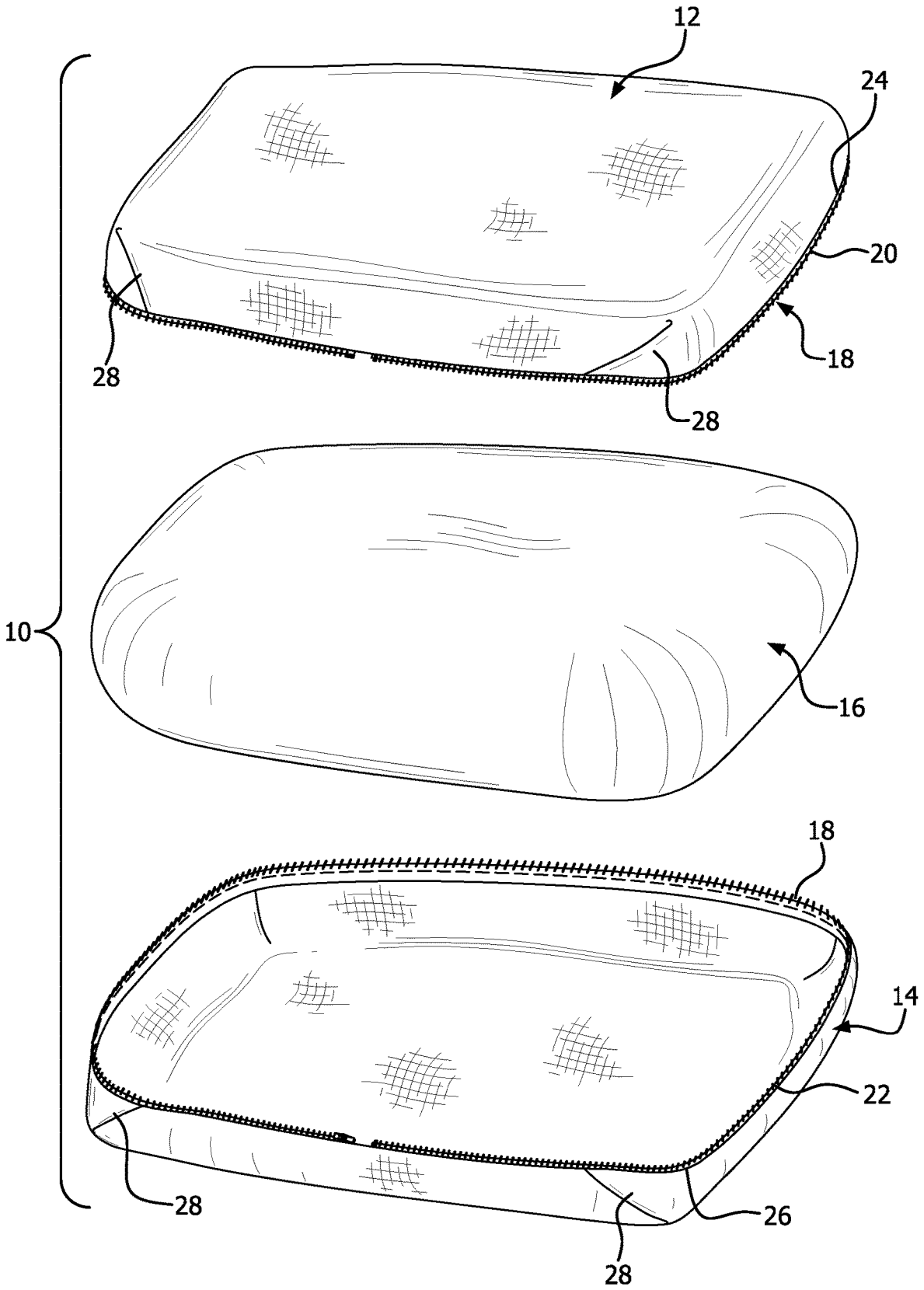

In the various view of the accompanying drawings, like numerals are used to designate similar elements. In FIG. 1 there is shown a cover construction designated by the numeral 10. The cover construction 10 is shown in exploded view and includes a first or top cover portion 12 and a second or bottom cover portion 14. A shaped article in the form of a pillow 16 is provided between the top cover portion 12 and the bottom cover portion 14. Other shaped articles may also be used along with the contemplated cover construction, including cushions, containers, and various other shaped articles.

Figure 2:
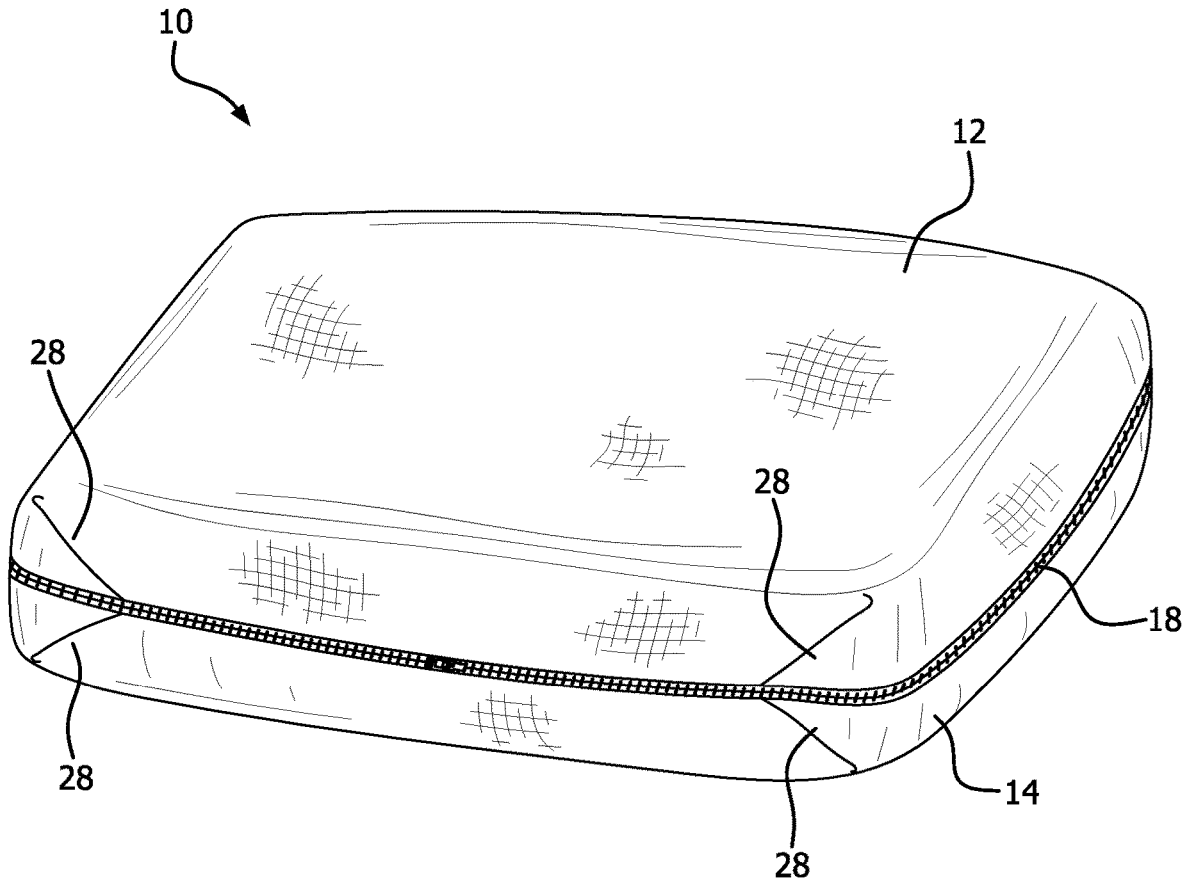
FIG. 2 shows an isometric view of the assembled cover construction as contemplated by FIG. 1.

As shown in FIG. 2, the two cover portions 12, 14 are attached together by means of a fastener in the form of a zipper 18. The attachment of the two cover portions 12, 14 creates an interior case or cavity (not shown) that retains the pillow article 12. As shown in FIG. 1, the zipper has first and second portions of halves 20, 22. The first zipper portion 20 is attached to a periphery or edge 24 of the first cover portion 12. The second zipper portion 22 is attached to the periphery or edge 26 of the second cover portion 14. These two zipper portions 20, 22 are joined together to close the zipper 18.

As shown in FIGS. 1 and 2, the pillow construction 10 has a generally rectangular configuration. As such, there are four corners. The opposing side edges are generally the same length, and as shown the adjacent sides are of differing length. If the sides are equal in length, the rectangle would be in the form of a square. Other shapes, with multiple lengths, corner angles and number of sides are also possible. As shown, each of the four corners of the two cover portions 20, 22 have a formed gusset 28. The construction of the gussets 28 are described in more detail below.

Figure 3:
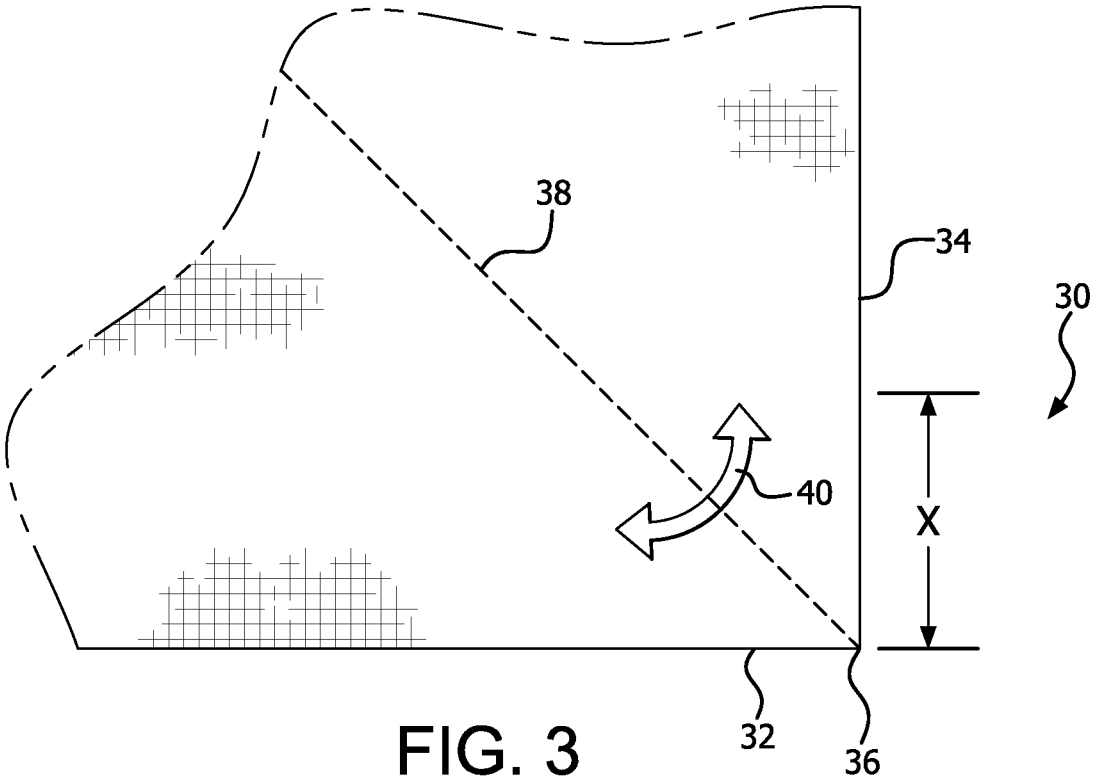
FIG. 3 shows a partial view of a corner of the cover body of the embodiment of FIGS. 1 and 2.

Starting at FIG. 3, there is shown the assembly of the gussets 28. In FIG. 3 there is shown a corner 30 of the body of a cover portion, for example, the first cover portion 12. A first side edge 32 and a second side edge 34 form a portion of the periphery 24 of the body of the cover portion 12, and are positioned on opposite sides of a corner point 36. A first fold line 38 is shown as extending inwardly from the corner point 36. The first fold line 38 is transverse to the point 36. Because the cover body is shown as having a rectangular configuration, the fold line 38 is preferably formed at an angle of about forty-five degrees from both the first side edge 32 and second side edge 34 of the cover body. Other angles may be appropriate depending on the desires of the maker. Angular or positional changes may result in variations in the shape of the gussets and the overall shape of the individual cover portions. The first fold is designated by arrow 40, bringing adjacent portions of the corner 30 together along the fold line 38.

Figure 4:
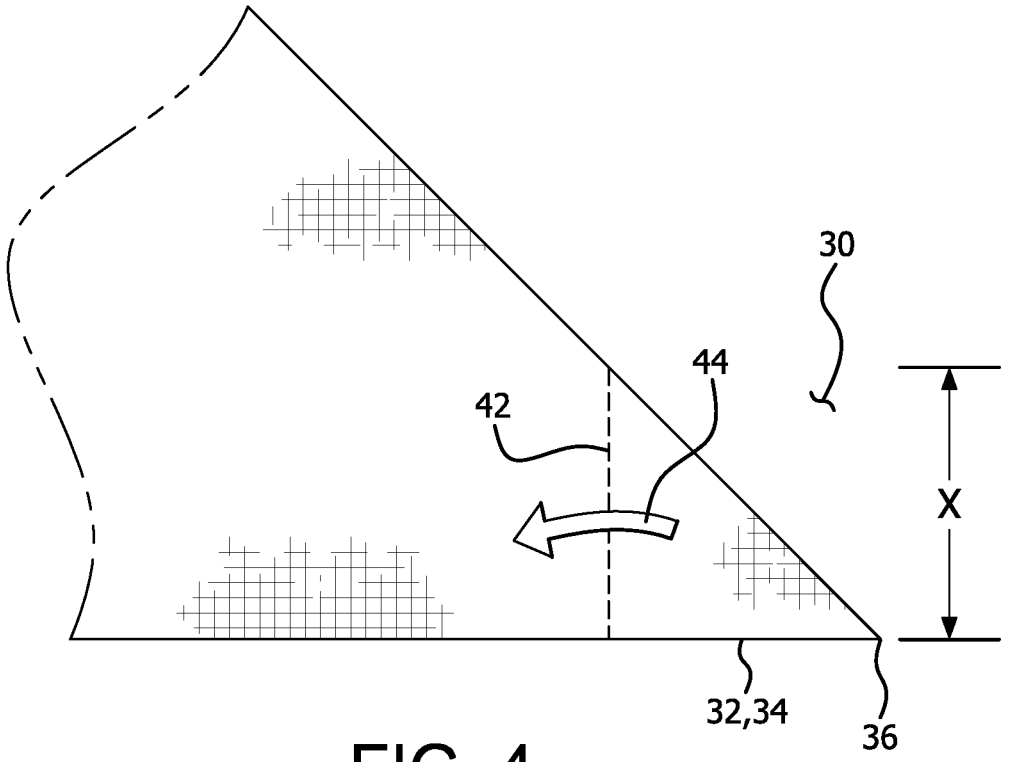
FIG. 4 shows a first assembly step for the corner shown in FIG. 3.

In FIG. 4, there is shown the corner 30 after completing the first fold 40 as contemplated by FIG. 3. Once the first fold 40 is completed, a second fold is performed, see arrow 44, along the second fold line 42. As shown, the height X is designated as the height of the second fold 44. This height X will result in a certain amount of overlap of the material along the peripheral edge of the corner 30. In the example of a rectangular corner 30 and a forty-five degree first fold line 38, the height X will equal the length Y (see FIG. 5) of the overlap.

Figure 5:
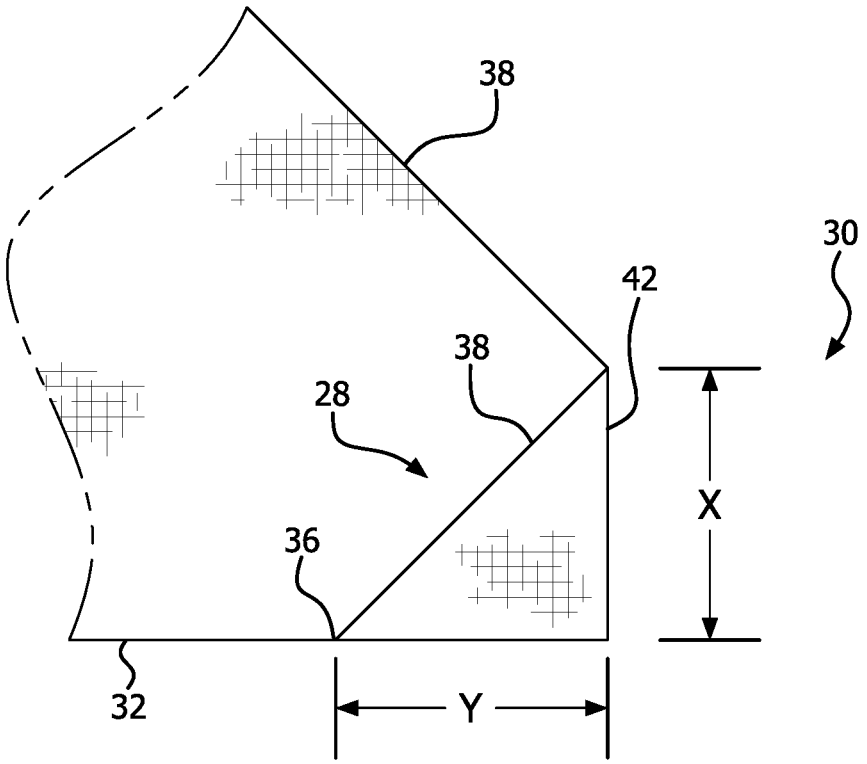
FIG. 5 shows a second assembly step for the corner shown in FIG. 4.

In FIG. 5 there is shown the corner 30 after completing the first fold 40 and second fold 44. The folding of the corner point 36 creates an overlap along an adjacent portion of the side edge 32. The length of the overlap Y may be chosen by the designer to adjust the shape and position of the gusset.

Figure 6:
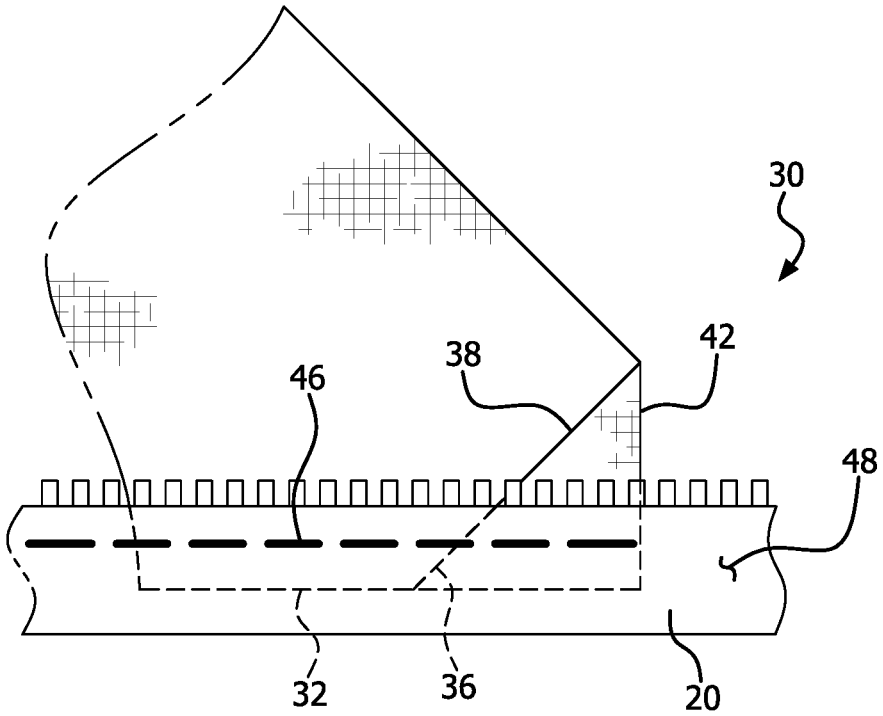
FIG. 6 shows a further assembly step of adding a zipper to the corner shown in FIG. 5.
Figure 7:
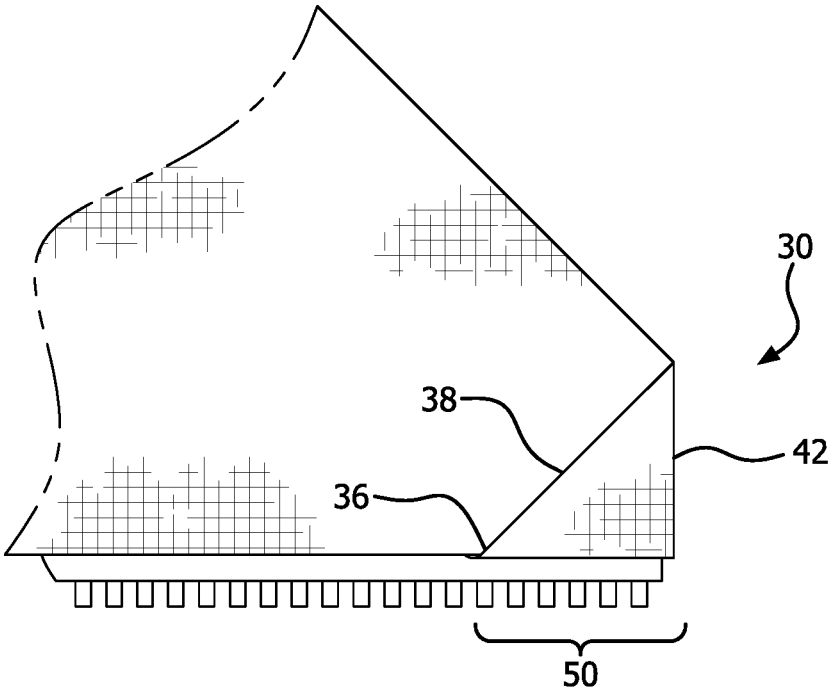
FIG. 7 shows an assembled corner as contemplated by FIGS. 3-6.
Figure 8:
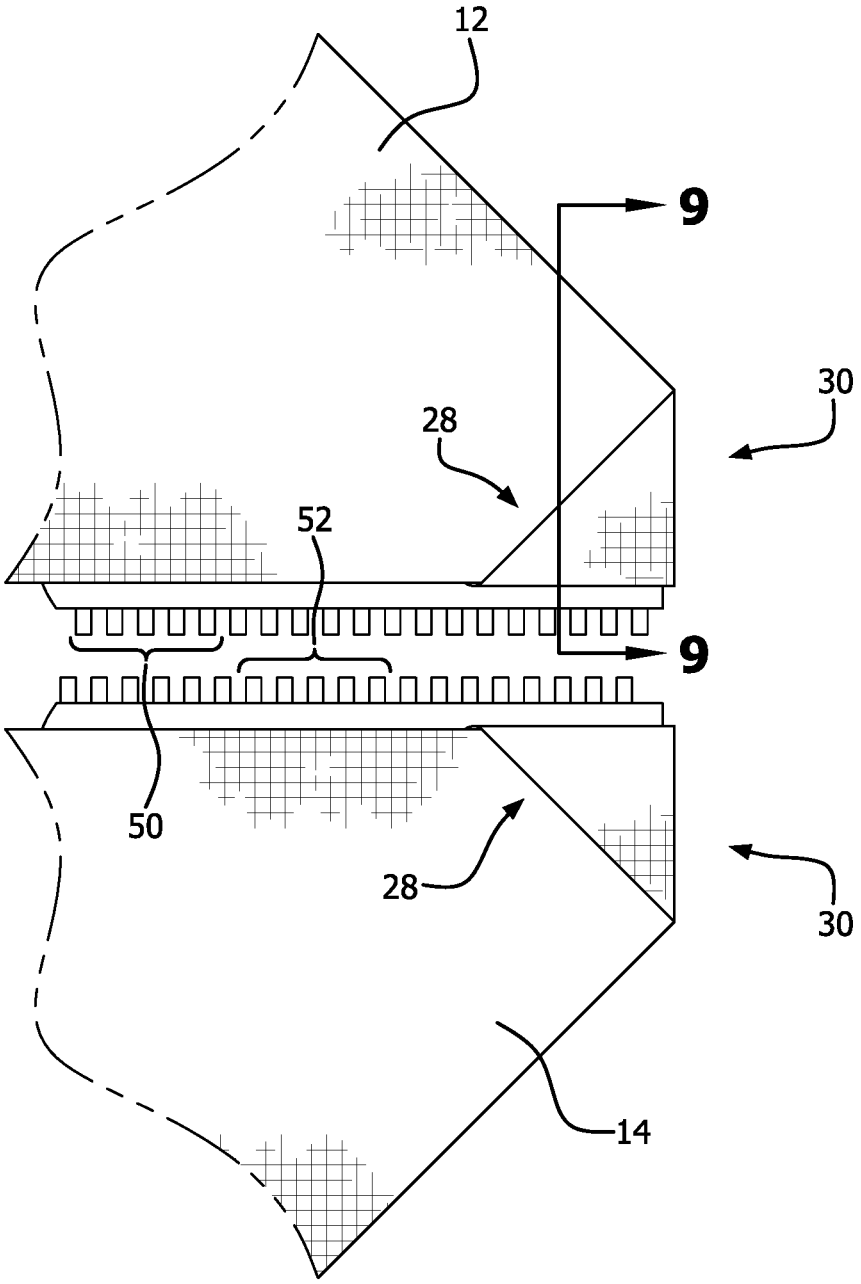
FIG. 8 shows an exploded view of two corner assemblies.
Figure 9:
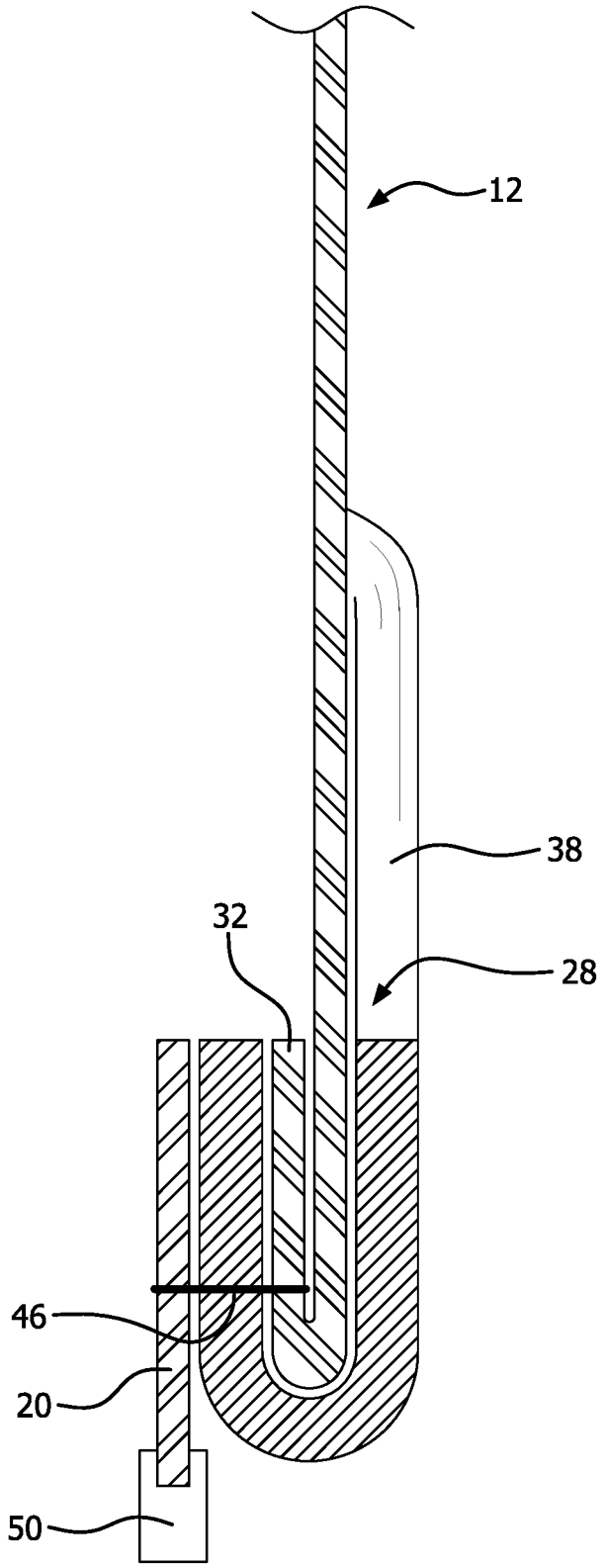
FIG. 9 shows a cross sectional view of one corner assembly as taken along lie 9-9 in FIG. 8.
Figure 10:
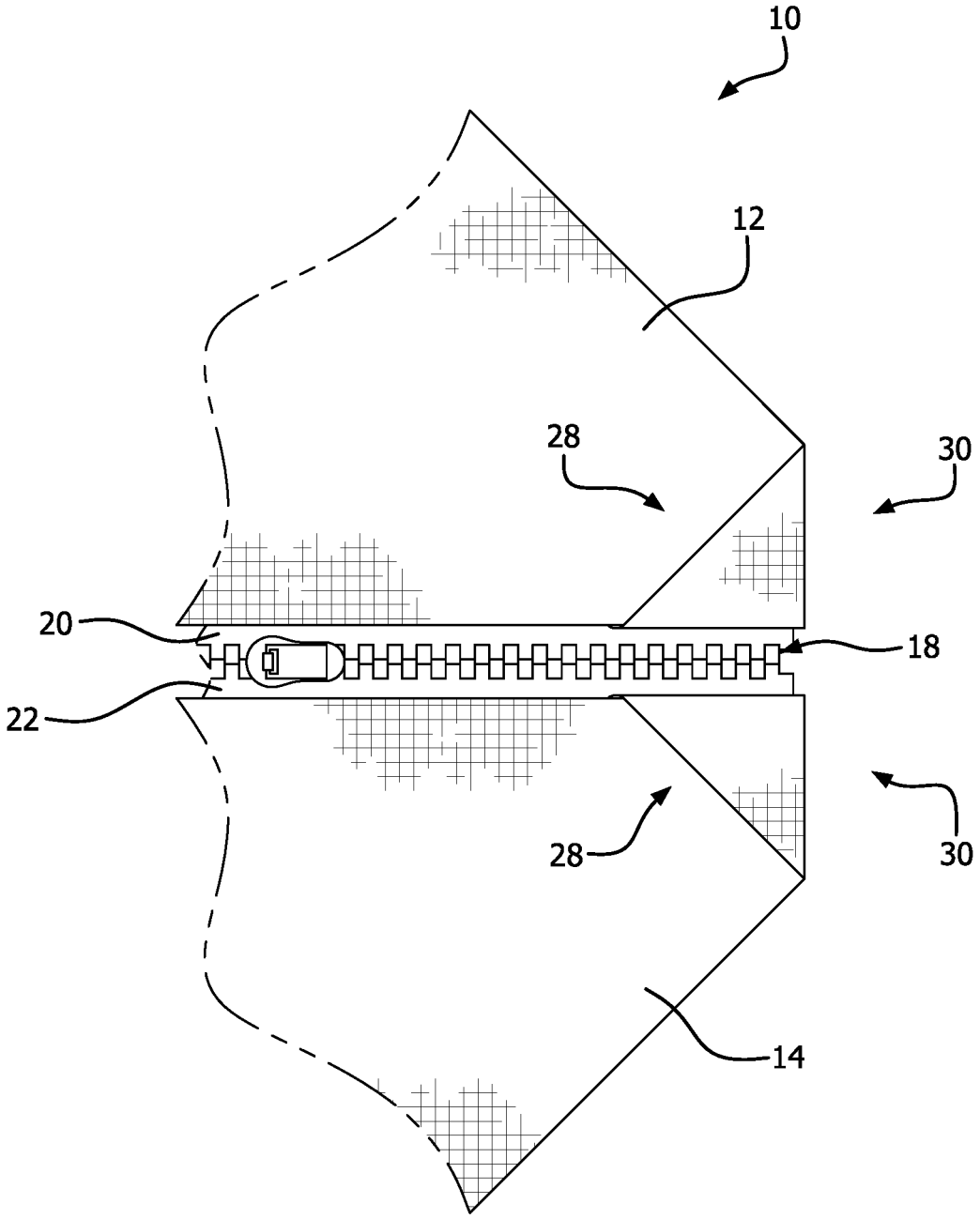
FIG. 10 shows the two corner assemblies of FIG. 8 having been fastened to one another.
Figure 11:
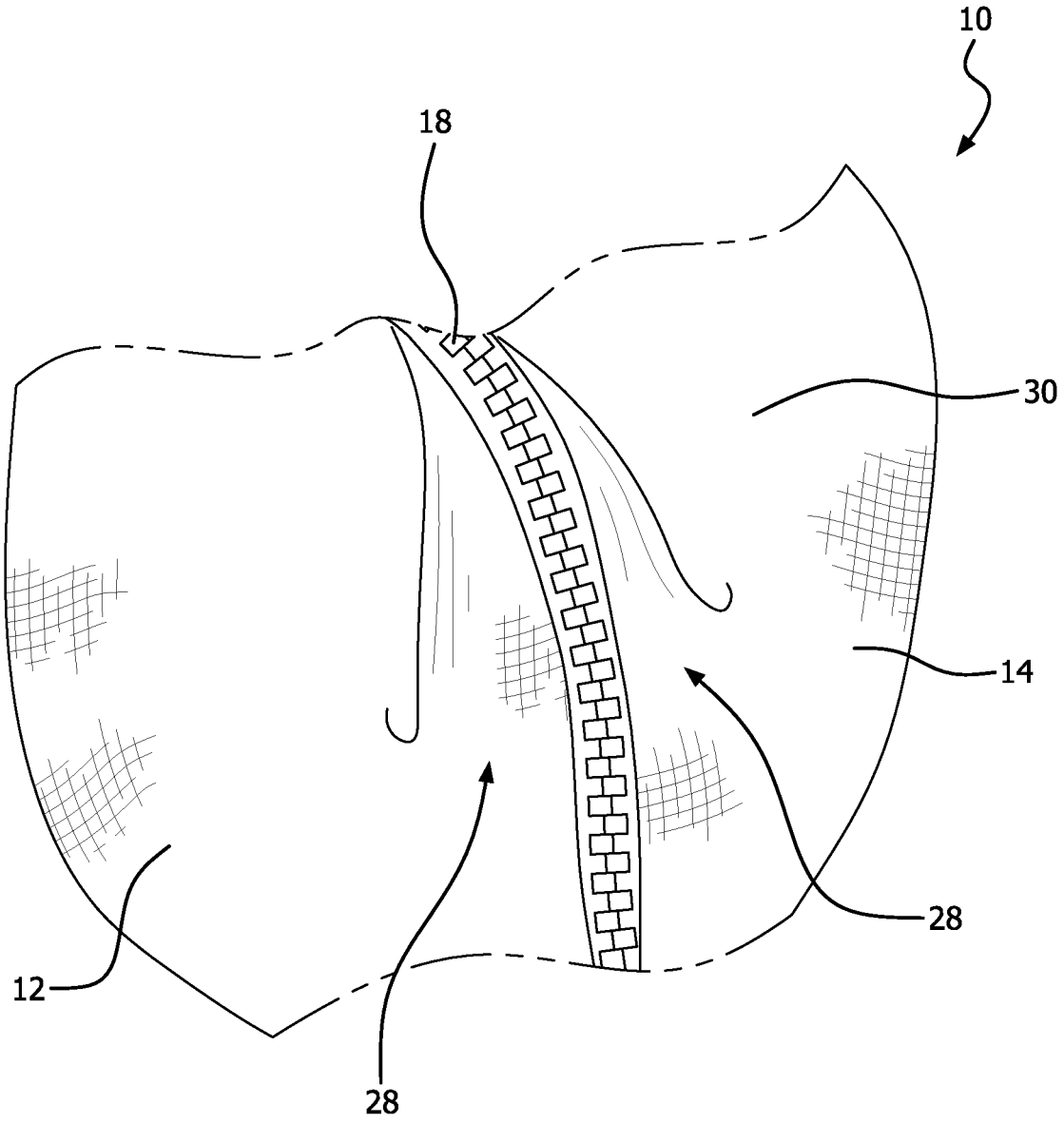
FIG. 11 shows a partial isometric view of the assembled corner FIG. 10.

As shown in FIG. 6, the first zipper portion 20 is formed by a stringer portion and line of locking teeth. The stringer of the zipper portion 20 is attached at stich line 46 to the outside surface of the body of the cover portion 12. Stich line 46 is preferably parallel to the first side edge 32. The folded second side edge 34 (see FIGS. 3 and 4) is separated from the first side edge 32 during this attachment. The extension 48 of the zipper portion 20 is preferably wrapped around the second fold line 42 and attached (not shown) to the second side edge 34 to complete the substantially continuous loop of the periphery on the first cover portion 12 (see FIG. 1). In FIGS. 7 and 8, the stitching 46 and attached surfaces of the first side edge 32 are shown as being folded inwardly and behind the folded corner 30. This inward folding of the zipper stringer and periphery of the material of the cover body creates a clean edge for the first cover portion 12. As shown in FIG. 8, the engagement teeth 50 of the first zipper portion 20 are directed outwardly from the cover body, with the matching zipper teeth 52 of the second zipper portion 22 on the other cover portion 14. In FIG. 10, the portions 20, 22 of the zipper 18 are engaged to fasten the two cover portions 12, 14 and complete the cover construction 10.

In the drawings, the opposing corner 30 of the second cover portion 14 includes a similar fold combination and gusset 28, only in a mirrored position as that of the corner 30 of the first cover portion 12. In the rectangular form illustrated, each corner 30 includes a folded gusset 28. The opening created by adjacent gussets on each cover portion may be positioned to face one another, such as the form shown in FIGS. 1 and 2. Alternating or similarly directed gussets may also be provided. The open gusset form results from the folded fabric portions that remain unattached inwardly from the peripheral edge of the cover portion. However, the folded fabric may be attached in various ways without necessarily affecting the visually clean appearance of the corner and associated gusset. The overall appearance of the gusset may further be affected by the stiffness and texture of the material used for the cover body, the size and shape of the pillow, cushion or other article retained within the cavity, the angle of the first fold, the height of the second fold, the form of attachment of the zipper portion, etc.

As illustrated, it is preferred that the zipper or similar fastener extend substantially continuously around the periphery of the cover portions. Each half of the zipper includes a stringer which is attached to a set of locking teeth that combine to temporarily lock together to secure the zipper portions together. A slide is shown for combining and locking the teeth portions, in a conventional manner. End pins may also be provided on the tooth rows. Multiple zipper portions may be provided of any desired length. An overlap of the ends of the zipper may be provided if desired. The alternate fastener structures may include hook and loop fasteners, and snap rows, among others.

In a preferred application of the cover construction, the two cover portions are interchangeable and may be reversible. Hence, a plurality of cover members may be provided and mixed in the construction of the cover. This interchangeability may be used to create a new decorative appearance for the pillow or other article retained within the cover. Hence, the cover serves as ornamentation and the two cover portions may be combined in any desired pattern or theme. Further, a stained or worn cover portion may be replaced without the need for replacing both portions. In addition, piping may be added the cover to further defined the structure and ornamentation. Other ornamental and functional elements may be also added without departing from the contemplated construction.

The present disclosure shows and describes one or more exemplary embodiments. It should be understood by those skilled in the art from the foregoing that various other changes, omissions and additions may be made therein, without departing from the spirit and scope of the contemplated invention, with the scope of the invention being defined by the foregoing claims. Further, the terms herein are used in a generic and descriptive sense and are not necessarily for purposes of limitation. The scope of the invention is set forth in the following claims.

What is claimed is:

1. A cover for a shaped article, such as a pillow, cushion or other article, the cover comprising:

a first cover portion, the first cover portion having a cover body and a defined peripheral edge;

a second cover portion, the second cover portion having a cover body similarly formed as the first cover portion and have a similarly defined peripheral edge;

a first fastener portion attached to the peripheral edge of the first cover portion; and a second fastener portion attached to the peripheral edge of the second cover portion, the first and second fastener portions adapted to releasably join to one another to secure the peripheral edges of the first and second cover portions to one another and to create an interior pocket for storage of the shaped article;

the first and second cover portions having at least one open gusset located along the peripheral edge of the respective cover portions, the at least one gusset formed by a first fold transverse to the peripheral edge of the cover portion, the first fold forming a pointed edge, and a second fold positioned perpendicular to the peripheral edge, the second fold formed by overlapping the pointed edge along to the periphery of the cover portions, with the pointed edge and adjacent overlapped portion secured to the peripheral edge, wherein the open gusset is formed at the second fold relatively inwardly of the peripheral edge.

2. A cover as claimed in claim 1, wherein the cover body of at least one of the first and second cover portions has a rectangular shape, and the at least one gusset is formed at a corner of the rectangle.

3. A cover as claimed in claim 2, wherein the first fold is formed substantially transverse to the corner of the rectangular shape of the cover body.

4. A cover as claimed in claim 1, wherein the cover bodies of the first and second cover portions each have a rectangular shape, and the at least one gusset is formed at each corner of the rectangle on each of the cover bodies.

5. A cover as claimed in claim 4, wherein the rectangular cover bodies have equal length side edges, forming a square shape.

6. A cover as claimed in claim 1, wherein the faster comprises a zipper having two sets of locking teeth.

7. A cover as claimed in claim 6, wherein the two sets of locking teeth are releasably joined substantially continuously around the periphery of the cover body portions.

8. A cover for a shaped article, the cover comprising:

a top cover portion, the top cover portion having a cover body and a defined periphery;

a bottom cover portion, the bottom cover portion having a cover body and a defined periphery;

a first zipper half attached to the periphery of the top cover portion; and a second zipper half attached to the periphery of the bottom cover portion;

at least one of the top and bottom cover portions having a gusset located along the periphery of the respective cover portion, the gusset formed by a first fold extending inwardly from the periphery of the respective cover portion, the first fold forming a pointed edge, a second fold spaced from the pointed edge and positioned transverse to the periphery of the respective cover portion, the pointed edge positioned along an adjacent periphery and secured to the overlapped portion along the adjacent periphery, the gusset formed relatively inward of the overlap formed by the second fold, the first and second zipper halves adapted to removably join and close the zipper, the closed zipper attaching the top and bottom cover portions along their peripheries and forming an interior pocket for storage of the shaped article.

9. A cover as claimed in claim 8, wherein the cover bodies of the top and bottom cover portions each have a rectangular shape, and a gusset is formed at each corner of the rectangle on each of the cover bodies.

10. A cover as claimed in claim 9, wherein the first fold for each gusset is formed along a line extending inwardly from the corner at an angle of substantially forty-five degrees from the adjacent side edges of the rectangle.

11. A cover as claimed in claim 10, wherein the second fold for each gusset is formed perpendicular to the adjacent peripheral edge.

12. A cover as claimed in claim 11, wherein the second fold for each gusset has a fixed height.

13. A cover as claimed in claim 12, wherein the height of the second fold for each gusset is equal.

14. A cover as claimed in claim 11, wherein for at least two adjacent gussets on each cover portion are directed towards one another.

* * * * *